US005094165A

United States Patent [19]

Sugiyama et al.

[11] Patent Number: 5,094,165

[45] Date of Patent: Mar. 10, 1992

[54] PLATE LOCKUP APPARATUS FOR SHEET-FED PRESS

[75] Inventors: Hiroyuki Sugiyama, Ibaraki; Toshio Miyamato; Kazuhiro Maejima, both of Chiba, all of Japan

[73] Assignee: Komori Corporation, Tokyo, Japan

[21] Appl. No.: 561,687

[22] Filed: Aug. 1, 1990

[30] Foreign Application Priority Data

| | | | |
|---|---|---|---|
| Aug. 4, 1989 | [JP] | Japan | 1-201276 |
| Aug. 21, 1989 | [JP] | Japan | 1-213096 |
| Dec. 6, 1989 | [JP] | Japan | 1-315381 |

[51] Int. Cl.[5] ..... B41F 1/28

[52] U.S. Cl. ..... 101/415.1; 101/DIG. 36; 101/378

[58] Field of Search ..... 101/415.1, DIG. 36, 101/378, 382, 383

[56] References Cited

U.S. PATENT DOCUMENTS

| | | | |
|---|---|---|---|
| 3,659,525 | 5/1972 | Woessner et al. | 101/378 |
| 4,068,586 | 1/1978 | Frey et al. | 101/415.1 |
| 4,546,702 | 10/1985 | Dorow | 101/415.1 |
| 4,688,484 | 8/1987 | Herold et al. | 101/378 |
| 4,727,807 | 3/1989 | Suzuki et al. | 101/415.1 |

FOREIGN PATENT DOCUMENTS

| | | | |
|---|---|---|---|
| 3532003 | 3/1987 | Fed. Rep. of Germany | 101/415.1 |
| 85957 | 5/1985 | Japan | 101/415.1 |
| 204038 | 8/1990 | Japan | 101/415.1 |

*Primary Examiner*—Edgar S. Burr
*Assistant Examiner*—Joseph R. Keating
*Attorney, Agent, or Firm*—Remy J. VanOphem

[57] ABSTRACT

A plate lockup apparatus for a printing press includes a leading-side lockup device, a trailing-side lockup device, and a cam mechanism. The trailing-side lockup device is located in the gap of the plate cylinder and grips a trailing edge of the plate, the trailing-side lockup device having a lockup table and a gripper plate, each having a plate gripper surface extending in a radial direction of the plate cylinder. The lockup table and the gripper plate are connected to each other at non-gripping ends thereof through a shaft. The cam mechanism has a cam, a cam surface of which is in contact with the lockup table. The cam mechanism is operated such that at a start of pivotal movement of the cam, the plate gripper surfaces of the lockup table and the gripper plate are closed to grip the plate, and at an end of pivotal movement of the cam, the lockup table and the gripper plate are moved together in a circumferential direction of the plate cylinder to tighten the gripped plate.

3 Claims, 11 Drawing Sheets

PLATE LOCKUP APPARATUS FOR SHEET-FED PRESS

BACKGROUND OF THE INVENTION

The present invention relates to a plate lockup apparatus mounted in a plate cylinder of a printing press so that leading and trailing edges of a plate to be wound around the plate cylinder are fixed within a gap axially formed in the outer circumferential surface of the plate cylinder.

A gap having a substantially rectangular sectional shape is formed along the entire length in the outer circumference of each plate cylinder in each printing press. A plate lockup apparatus consisting of a leading-side lockup device for gripping the leading edge of the plate and a trailing-side lockup device for gripping the trailing edge of the plate is fixed on the bottom surface of the gap to extend in the axial direction of the plate cylinder.

Each of the conventional leading- and trailing-side lockup devices has an elongated lockup table extending in the axial direction of the plate cylinder, a plurality of gripper plates, swingably supported at an edge portion of this lockup table by a plurality of bolts, for gripping or releasing the plate with or from the lockup table, and a plurality of cams which can be respectively engaged with gaps at the leading edges of the gripper plates. The plurality of axially parallel cams are pivotally fixed along the axis. A plurality of compression coil springs are interposed between the lockup table and the gripper plates to bias the gripper plates in an open direction. The lockup table in the trailing-side lockup device is supported on the bottom of the gap to be movable along the circumferential direction of the plate cylinder. A plurality of plate tension bolts are threadably engaged with a plurality of longitudinal portions of the lockup table so that the distal ends of the bolts abut against the wall surface which defines the gap.

With the above arrangement, in order to mount a plate on a plate cylinder, when a cam shaft of the leading-side lockup device is pivoted, the gripper plates which are divided in the axial direction of the plate are released upon disengagement from the cams and are simultaneously opened by the elastic forces of the compression coil springs. An end of the plate is inserted between the leading-side lockup device and the corresponding lockup table. When the cam plate is pivoted in the direction opposite to the direction described above, the gripper plates are pivoted against the elastic forces of the compression coil springs by the behavior of the cams and are closed, thereby gripping the leading edge of the plate. After the leading edge of the plate is gripped, the plate is wound around the plate cylinder. The trailing edge of the plate is gripped by the trailing-side lockup device in the same manner as the leading edge. The plate tension bolts are tightened to move the trailing-side lockup device in the circumferential direction of the plate cylinder, so that the plate is brought into tight contact with the plate cylinder. Since spring members are interposed between the trailing-side lockup device and the gap, when the plate tension bolts are loosened, the plate lockup device is moved toward the wall surface of the gap by the spring forces of the spring members, thereby tightening the plate.

In the conventional plate lockup apparatus having the above arrangement, however, since the plate is inserted between the lockup table and the gripper plates from a tangential direction of the plate cylinder while the plate end portion is not bent but kept straight, it is technically very difficult to grip the plate straight without any deformation. The tensions along the widthwise direction become nonuniform upon tightening of the plate. An error tends to occur in the reference printing point.

In order to solve this problem, an apparatus disclosed in Japanese Patent Laid-Open No. 1-127346 is proposed. In this apparatus, the lockup tables and the gripper plates are disposed in the radial direction of a plate cylinder so that a trailing-side gripper surface of the plate conventionally formed in the circumferential direction of the plate cylinder is formed in the radial direction of the plate cylinder. The edge of the plate is bent at a right angle by an external bending machine.

With this arrangement, after the leading edge of the plate is gripped, the bent portion of the trailing edge portion of the plate wound around the circumferential surface of the plate is inserted between the lockup tables and the gripper plates. The gripper plates are swung by a cam mechanism to grip the bent portion of the plate. The trailing-side lockup device as a whole is circumferentially moved to unfirmly mount the plate, thereby bringing the plate into tight contact with the surface of the plate cylinder.

In such a sheet-fed press, when an old plate is replaced with a new plate due to changes in contents of printed matters, the plate cylinder is pivoted to cause the trailing-side cam shaft to oppose an operating position, and the trailing-side cam shaft is pivoted to open the trailing-side lockup device. One end of the plate which is released from gripping is kept held, and the plate cylinder is rotated so that the leading-side lockup device opposes the operating surface. The leading-side cam shaft is pivoted to open the leading-side lockup device to release the other end of the plate from gripping, thereby removing the old plate. Thereafter, opening/closing of the plate lockup devices and the pivotal operation of the plate cylinder are repeated to mount the new plate.

In the conventional plate lockup apparatus having the above arrangement, plate gripping and plate tightening are performed by separate mechanisms, and the structure is undesirably complicated. In addition, the number of operating steps is increased, and good operability is not always obtained, thus presenting the first problem.

As described above, since the plate gripper surface is opened/closed, the cam shaft must be manually pivoted. The number of operating steps is increased, operability is degraded, and much labor is required. In addition, a preparation time is undesirably prolonged to degrade productivity, thus presenting the second problem.

Since the pivotal operation of the leading-side cam shaft for opening the leading-side lockup device and the pivotal operation of the trailing-side cam shaft for opening the trailing-side lockup device must be performed at different phases of the plate cylinder, a plate replacement time is undesirably prolonged, the total preparation time is prolonged, and the productivity is degraded, thus presenting the third problem.

SUMMARY OF THE INVENTION

It is an object of the present invention to provide a plate lockup apparatus for a sheet-fed press, capable of reducing the number of operating steps and improving operability.

It is another object of the present invention to provide a plate lockup apparatus for a sheet-fed press, capable of shortening a preparation time and improving productivity.

It is still another object of the present invention to provide a plate lockup apparatus for a sheet-fed press, capable of shortening a plate replacement time, shortening a total preparation time, and further improving productivity.

In order to achieve the above objects of the present invention, there is provided a plate lockup apparatus for a printing press, having a leading-side lockup device, located in a gap in a circumferential surface of a plate cylinder, for gripping a leading edge of a plate; a trailing-side lockup device, located in the gap of the plate cylinder, for gripping a trailing edge of the plate, the trailing-side lockup device having a lockup table and a gripper plate, each having a plate gripper surface extending in a radial direction of the plate cylinder, the lockup table and the gripper plate being connected to each other at non-gripping ends thereof through a shaft, and a cam mechanism having a cam, a cam surface of which is in contact with the lockup table. The cam mechanism is operated such that at a start of pivotal movement of the cam, the plate gripper surfaces of the lockup table and the gripper plate are closed to grip the plate, and at an end of pivotal movement of the cam, the lockup table and the gripper plate are moved together in a circumferential direction of the plate cylinder to tighten the gripped plate.

According to the present invention, after one end of the plate is inserted between the open gripper plates and the lockup table in the leading-side lockup device and is then gripped, the plate is wound around the circumferential surface of the plate cylinder, and the bent portion of the other end of the plate is inserted between the open gripper plates and the lockup table of the trailing-side lockup device. When the cam shaft is pivoted, the gripper plates are closed to grip the bent portion of the plate. When the cam shaft is continuously pivoted, the lockup device and the gripper plates are moved together in the circumferential direction of the plate, thereby tightening the plate and bringing the plate into tight contact with the circumferential surface of the plate cylinder.

According to the present invention, at the time of plate replacement, each one-side drive unit is driven at a position of a corresponding one-side lever pivot member located at a position corresponding to the leading-side lever to urge the lever through a link mechanism. The cam shaft is pivoted to cause a large-diameter portion of the cam to swing each gripper plate. The gripper surface is opened to release the plate. In this state, the plate cylinder is pivoted and the one-side drive unit is driven at a position where one-side lever pivot member is in contact with the trailing-side lever, so that the cam is pivoted to bring the small-diameter portion into contact with the trailing-side lockup table. Therefore, the plate gripper surface is opened to release the plate, thereby removing the unnecessary plate.

The plate cylinder is pivoted and the one-side lever pivot member corresponds to the leading-side lever, so that one end of the new plate is inserted into the open leading-side gripper surface, and the one-side drive unit is operated to rotate the cam shaft. The small-diameter portion of the cam is brought into contact with the gripper plates, thereby closing the gripper plates and gripping the plate. The plate cylinder is then rotated by one revolution. The bent portion of the other end portion of the new plate is inserted into the open trailing-edge plate gripper surface, and the one-side drive unit is operated to bring the large-diameter portion of the cam into contact with the lockup table. Therefore, the gripper surface is closed to grip the new plate.

According to the present invention, at the time of plate replacement, when the plate cylinder is stopped at a position where the trailing-side lockup device opposes the operating surface, and the drive unit is operated, the leading- and trailing-side lockup devices are simultaneously opened. Upon rotation of the plate cylinder by about one revolution, the old plate can be removed. The plate cylinder is pivoted to cause the leading-side lockup device to oppose the operating surface, and the leading edge of the new plate is inserted into the open leading-side lockup device. The leading-side lockup device is closed, and the plate cylinder is rotated by about one revolution to wind the plate around the outer circumferential surface of the plate cylinder. The trailing edge of the plate is then inserted into the trailing-side lockup device, and the trailing-side lockup device is closed to complete plate replacement.

DETAILED DESCRIPTION OF THE PREFERRED EMBODIMENT

Figure 1:
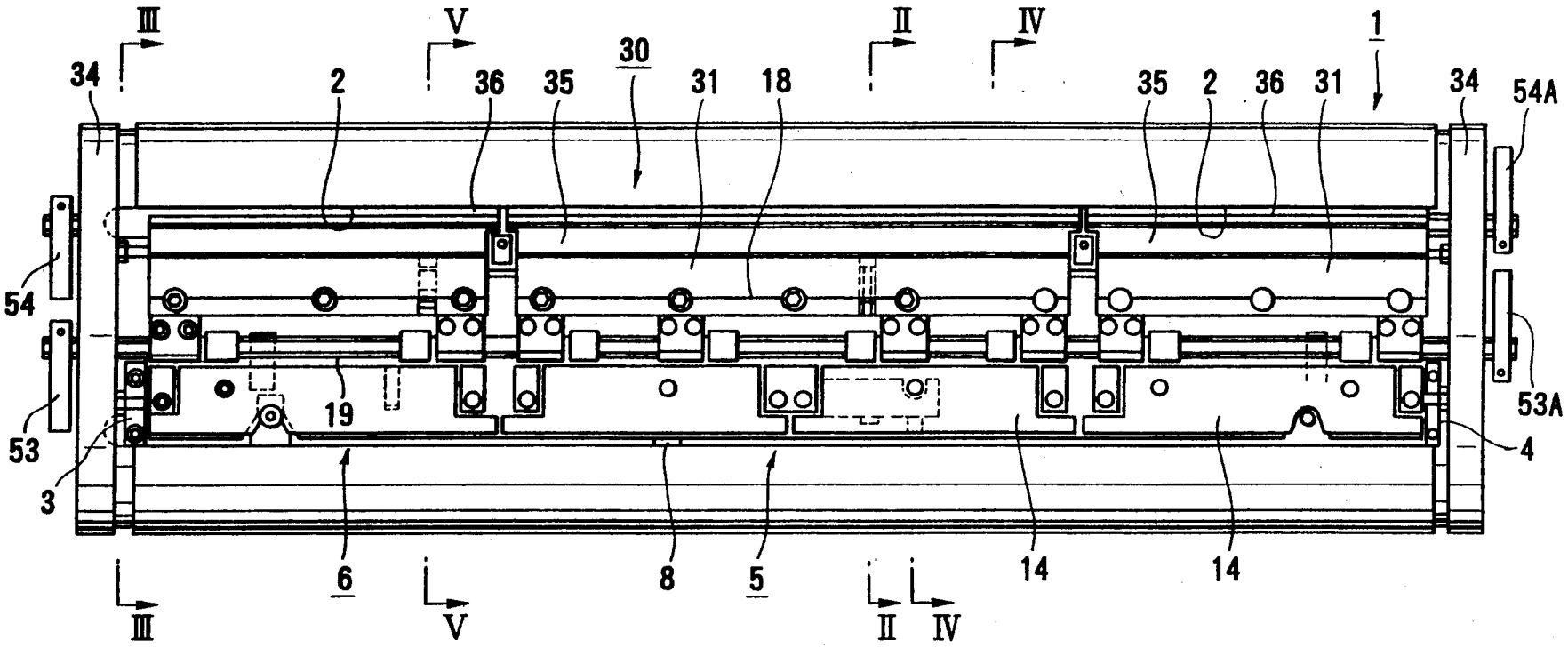
FIG. 1 is a plan view of a plate cylinder in a sheet-fed press having a plate lockup apparatus according to an embodiment of the present invention.

FIGS. 1 to 13 show an embodiment in which a plate lockup apparatus for a sheet-fed press according to the present invention is employed in an automatic plate replacement unit.

A gap 2 having a rectangular sectional shape is formed in the outer circumferential surface of a plate cylinder 1 along the entire length of the plate cylinder 1. Saddle-like left and right guides 3 and 4 are bolted on the bottom surface portions of the gap at both its ends.

A leading-side lockup device 5 includes a lockup table 6 having an almost square sectional shape and extending in the axial direction of the plate cylinder. Thin-walled portions at both ends of the lockup table 6 are fitted to be slightly circumferentially movable while their vertical movement is restricted by the left and right guides 3 and 4. The intermediate portion of the lockup table 6 is slidably pressed by a plurality of guides (not shown) fixed on the bottom surface of the gap 2, so that floating of the lockup table 6 is prevented. A plurality of screw holes **6*b* are formed in portions along the longitudinal direction of the lockup table 6 and each has a section shown in FIG. 4. An adjusting screw 7 whose distal end is tapered is threadably engaged with a corresponding one of the screw holes 6*b*. A collared pin 8, the collar portion of which is fitted between the lockup table 6 and the gap 2, is slidably inserted in each pin hole corresponding to each of the adjusting screws 7. The distal end of the collared pin 8 abuts against a tapered surface of the corresponding adjusting screw 7. With this arrangement, when the adjusting screw 7 is turned, the lockup table 6 is slightly moved in the circumferential direction by the behavior of the tapered surface. A compression coil spring 9, best seen in FIG. 5, is inserted between a stud 10 on the lockup table 6 and the wall surface of a recessed hole 2*a* of the gap 2 to bias the lockup device 5** outward.

Figure 5:
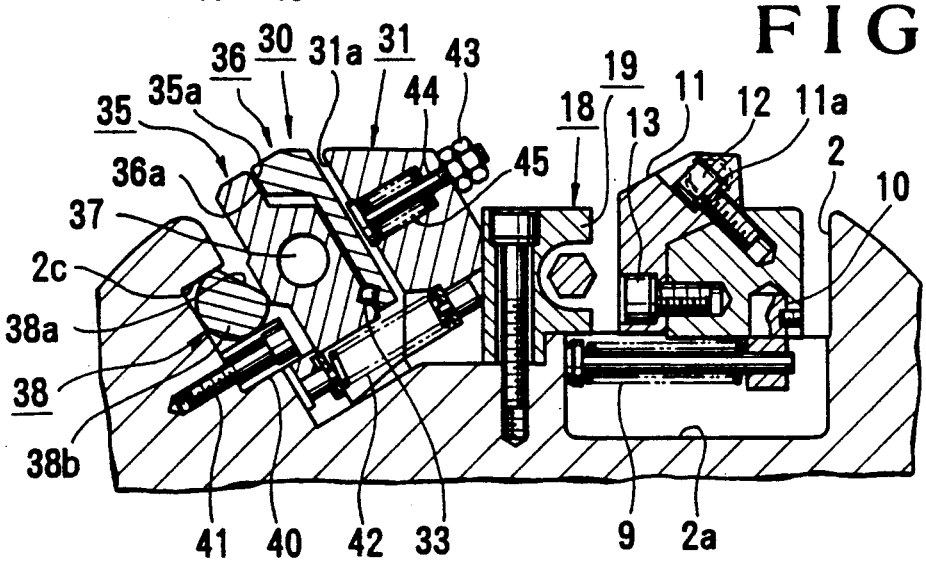
FIG. 5 is a sectional view of the plate cylinder along the line V—V in FIG. 1.

An L-shaped leading-side plate holder 11 shown in FIG. 5 is fixed by bolts 12 and 13 on the inclined surface of the lockup table 6. Three gripper plates 14 having a substantially V-shaped section, divided into the axial direction of the plate cylinder, and constituting the same overall length as that of the lockup table 6, are swingably supported on pins **11*a* horizontally extending from the plate holders 11. Each gripper surface 14*a* opposes the gripper surface of the lockup table 6. Although not shown, a plurality of projections are formed on the gripper surface 14*a* and are engaged with the recesses formed in the opposite gripper surface. A plurality of studs 15 each having a sectional shape shown in FIG. 2 extend upward from the bottom surface of the lockup table 6 so as to parallelly extend into the recessed hole 2*a* of the gap 2 in the axial direction of the plate cylinder. A compression coil spring 17 is inserted between a spring reception pin 16 threadably engaged with a screw hole of each stud 15 and the gripper plate 14 to bias the gripper plate in a direction so that the gripper surface 14*a* of the gripper plate 14** is closed.

A plurality of bearings 18 having a rectangular parallelepiped shape are fixed by bolts at the central part of the bottom surface of the gap 2 and are aligned along the axial direction of the plate cylinder. A hexagonal cam shaft 19 is fitted in the bearings 18. A plurality of plate gripper cams 20 each having large- and small-diameter portions are mounted on the cam shaft 19 in tandem with each other. The cam surface of each plate gripper cam 20 is in contact with a vertical surface of the corresponding gripper plate 14. Upon driving of the cam shaft 19 by a drive unit (to be described later), the large-diameter portions of the plate gripper cams 20 cause the gripper plates 14 to pivot in the counterclockwise direction against the biasing forces of the compression coil springs 17, so that the gripper surfaces **14*a*** are opened.

Trailing-side plate lockup devices 30 are arranged parallel to the leading-side lockup devices 5 within the gap 2. The trailing-side lockup device 30 has almost the same length as the overall length of the plate cylinder and has a spring reception bar 31 having a vertical surface which is in contact with the vertical surface of the corresponding bearing 18. The spring reception bar 31 is fixed on the bottom surface of the gap 2 by a plurality of bolts 32. The spring reception bar 31 includes a regulation surface **31*a* extending in the radial direction of the plate cylinder 1. A support shaft 33 extends between the regulation surface 31*a* and a wall surface 2*b* of the gap 2 so that both ends of the support shaft 33 are located near disc bearers 34 at both ends of the plate cylinder 1. Three separated lockup tables 35 and three separated gripper plates 36 have opposite gripper surfaces 35*a* and 36*a* extending in the radial direction of the plate cylinder 1 so that ends of the lockup tables 35 and the gripper plates 36 opposite to these gripper portions are swingably connected to each other through the support shaft 33. Reference numerals 37 denote adjusting screws for connecting the three separated lockup tables 35. Right- and left-hand threads are threadably engaged with screw holes of each lockup table 35. A tool is inserted into a hole of a collar portion 37*a* integrally formed between the two adjacent lockup tables 35 and is turned to adjust a distance between the adjacent lockup tables 35**.

A rod-like cam 38 formed by a planar small-diameter portion **38*a* and an arcuated large-diameter portion 38*b* is pivotally mounted on the bearer 34 in the recessed portion 2*c* formed in the wall surface 2*b* of the gap 2. An extended portion 38*c* of the cam 38 from the bearer 34 has a hexagonal shape. Reference numeral 40 denotes a guide for pivoting the cam 38 and is fixed in the recessed portion 2*c* of the wall surface 2*b* by a bolt 41. Compression coil springs 42 are interposed between a plurality of spring hole bottom surfaces formed in the non-gripper ends of the lockup tables 35 and the plurality of spring hole bottom surfaces formed in the spring reception bar 31 to separate the lockup tables 35 from the spring reception bar 31. A compression coil spring 45 is interposed between the bottom surface of the spring hole 31*b* and a collar portion of a spring shaft 44 whose movement is limited by a double nut 43 slidably mounted in the spring hole 31*b* of the upper portion of the spring reception bar 31 to separate each gripper plate 36 from the spring reception bar 31. A compression coil spring 46 is arranged within the spring hole of the upper portion of each lockup table 35 to bias the respective lockup table 35 from the corresponding gripper plate 36. Reference numeral 47 denotes a blanket cylinder which is brought into rolling contact with the plate cylinder 1**.

An opening/closing drive unit for pivoting the cam shaft 19 and the cam 38 to open/close each plate gripper surface will be described below. Each opening/closing drive unit is arranged near each of the right and left frames 50 for supporting the plate cylinder 1 and the blanket cylinder 47. The right drive unit (the left-hand unit in FIG. 1 for illustrative convenience) on the right frame 50 when viewed from the sheet feeder will be described first. An air cylinder 51 serving as a drive unit is swingably supported on the upper end face of the frame 50 through a bracket 52. Levers 53 and 54 are split-fixed on the leading-side cam shaft 19 and the trailing-side cam 38 between the bearer 34 and the frame 50. A link mechanism 55 is arranged between the air cylinder 51 and the levers 53 and 54. The distal end portion of a rod 57 connected to a piston rod 56 of the air cylinder 51 is connected to a free end portion of an L-shaped lever 59 pivotally supported on the upper surface of the frame 50 through a bracket 58. The lower end portion of a rod 60 whose upper end is connected to the other free end portion of the L-shaped lever 59 is connected to a free end portion of a lever 62 supported on a stud 61 of the frame 50. A lever 63 is formed integrally with the lever 62. A free end portion of the lever 63 is connected to one end of a roller lever 64. Reference numeral 65 denotes a lever shaft pivotally supported between the right and left frames so that axial movement of the lever shaft 65 is limited. A free end portion of a lever 66 is supported by the central portion of the roller lever 64. That is, a four-joint link is constituted by the levers 63 and 66 and the roller lever 64. When the lever 62 is driven by the air cylinder 51 and is swung, the roller lever 64 is reciprocated together with the levers 63 and 66 in the radial direction of the plate cylinder 1. A roller 67 which is selectively brought into contact with the lever 53 or 54 in accordance with a pivotal phase of the plate cylinder 1 is mounted on the distal end portion of the roller lever 64. When the roller lever 64 is reciprocated, the lever 53 or 54 is pivoted about the cam shaft 19 or the cam 38 within the range between the solid line and the alternate long and short dashed line in FIG. 7. In the right opening/closing drive unit, when the lever 53 is located at the position indicated by the solid line, the plate gripper surfaces of the leading-side lockup devices 5 are closed. However, when the lever 54 is located at the position indicated by the solid line, the plate gripper surfaces of the trailing-side lockup devices 30 are open.

Figure 7:
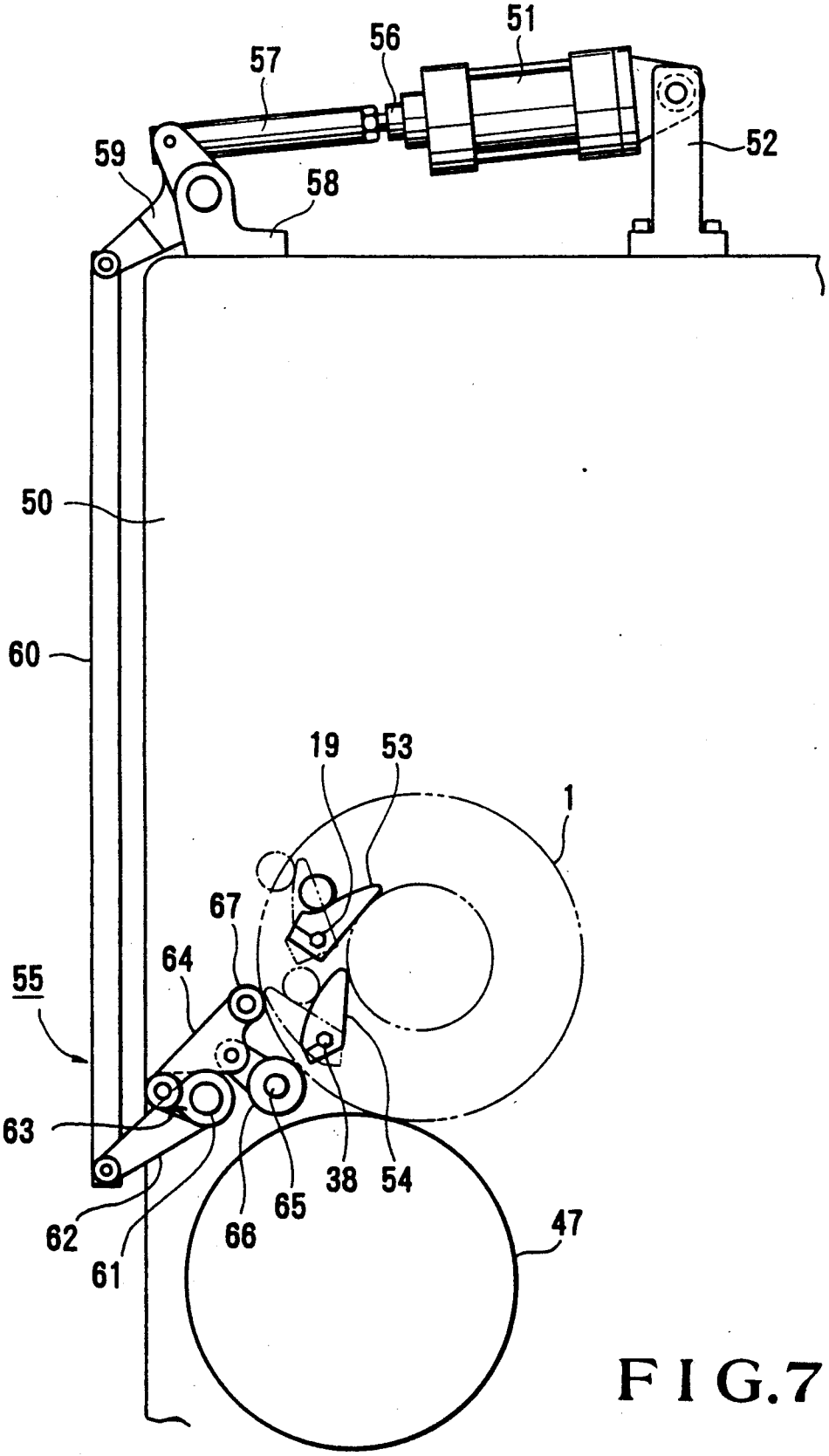
FIG. 7 is a side view of the plate lockup opening/-closing unit.
Figure 8:
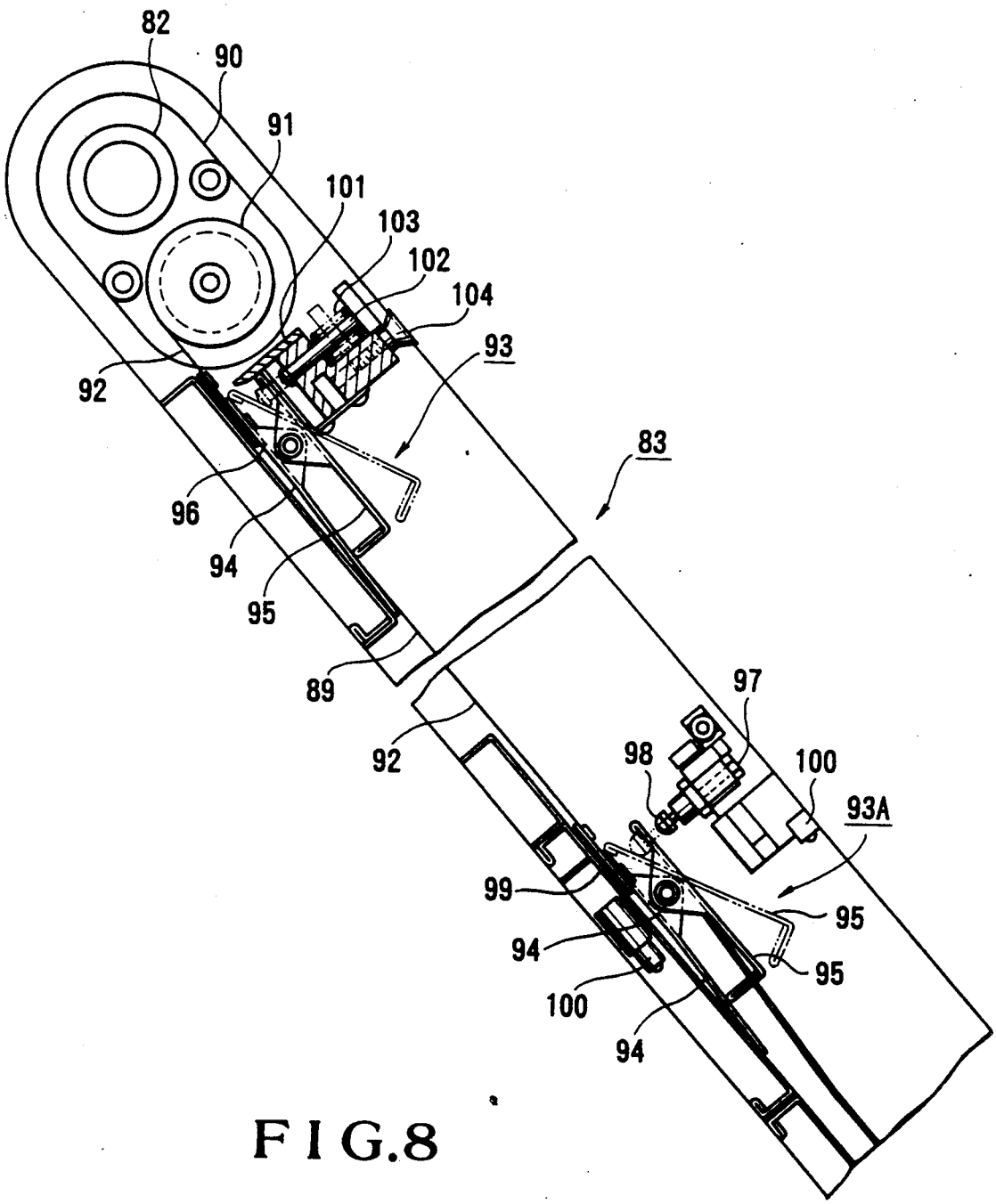
FIG. 8 is a partially cutaway side view showing the upper half of a plate holding unit.
Figure 13:
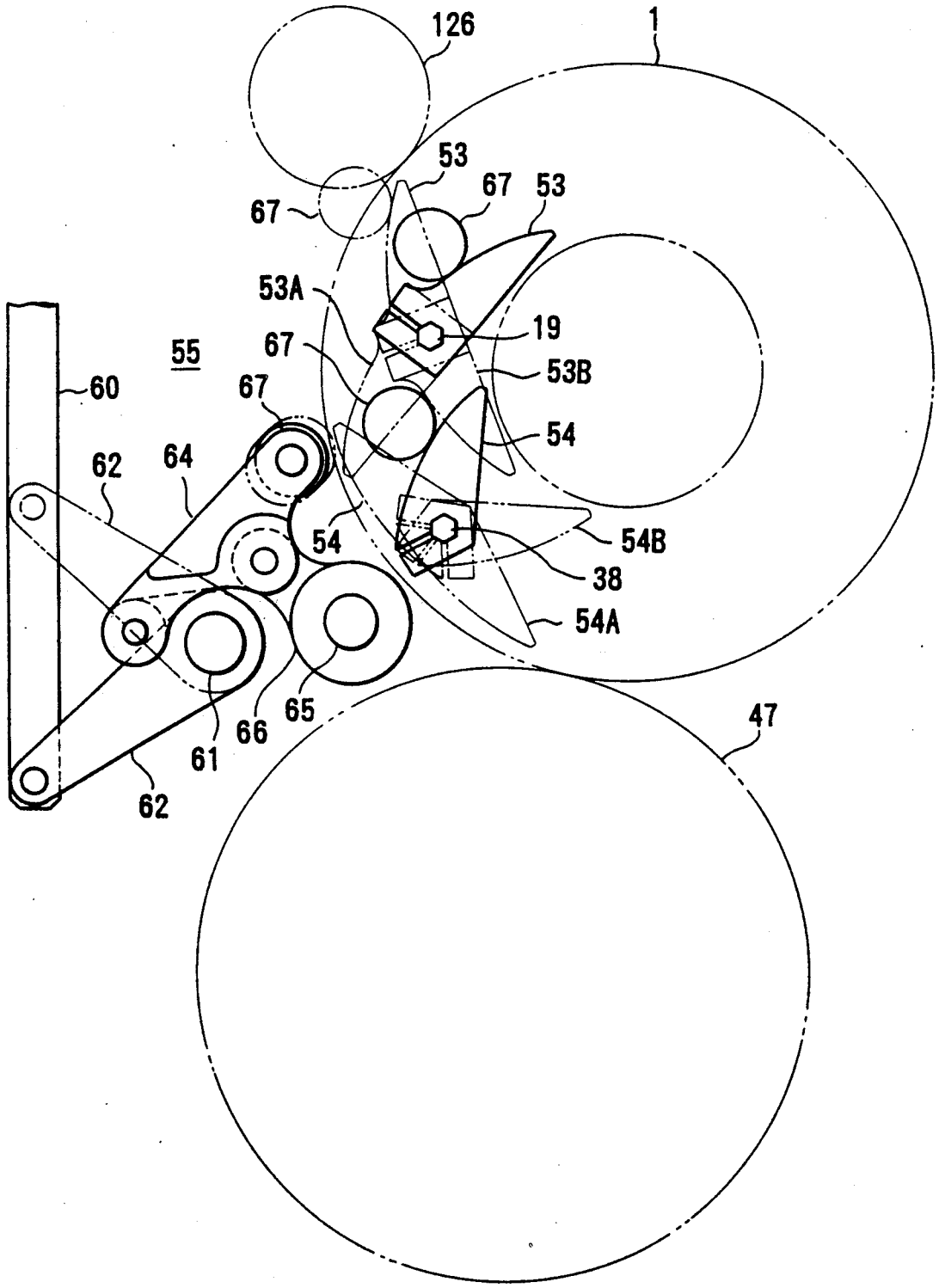
FIG. 13 is an enlarged front view of the plate lockup opening/closing unit.

The left opening/closing drive unit (the right drive unit in FIG. 1) on the left frame side when viewed from the sheet feeder is arranged similarly to the right opening/closing drive unit, although the left opening/closing drive unit is not illustrated in FIG. 7. The arrangement of the left opening/closing drive unit is the same as that of the right opening/closing drive unit as far as the components from the air cylinder 51 to the roller 67 are concerned. The arrangement of the left opening/closing drive unit is different from that of the left opening/closing drive unit in levers 53 and 54. That is, as shown in FIGS. 1, 7, and 13, the right levers 53 and 54 extend upward from the cam shaft 19 and the cam 38. However, in the left opening/closing drive unit, levers 53A and 54A in FIGS. 1 and 13 extend downward from the cam shaft 19 and the cam 38. That is, the distal end portion of the right trailing-side lever 54 and the distal end portion of the left leading-side lever 53A are in phase in the circumferential direction and oppose the rollers 67. With this arrangement, when the right and left air cylinders 51 are simultaneously actuated, the lever 54 is pressed by the right roller 67 to open the plate gripper surface of each trailing-side plate lockup device 30. At the same time, the left lever 53A is pressed by the roller and is moved to a position indicated by reference numeral 53B. At the same time, the right lever 53 is moved from the position of the solid line to the position of the alternate long and short dashed line, so that the plate gripper surface of each leading-side plate lockup device 5 is opened. Since the extending directions of the distal ends of the right and left levers 53 and 53A are opposite to each other, the right lever 53 is moved from the position of the alternate long and short dashed line to the position of the solid line, as shown in FIG. 13. The left lever 53A is moved from the position indicated by reference numeral 53B to the position indicated by reference numeral 53A. When the left lever 54A is moved from the position indicated by reference numeral 54A to the position indicated by reference numeral 54B, the right lever 54 is moved from the position of the solid line to the position of the alternate long and short dashed line.

Figure 11:
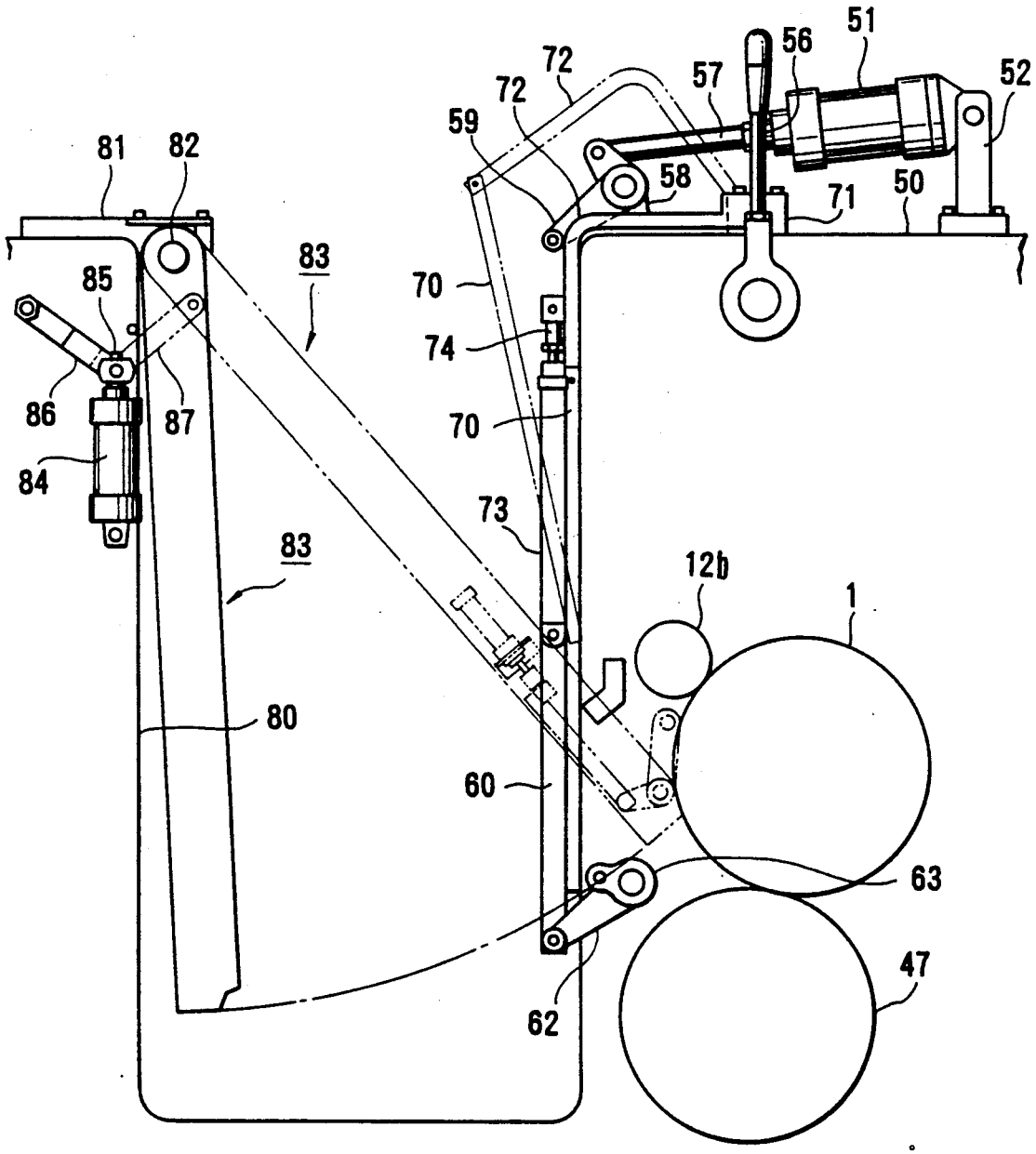
FIG. 11 is a side view showing the main part of a plate replacement unit which embodies the present invention.
Figure 12A:
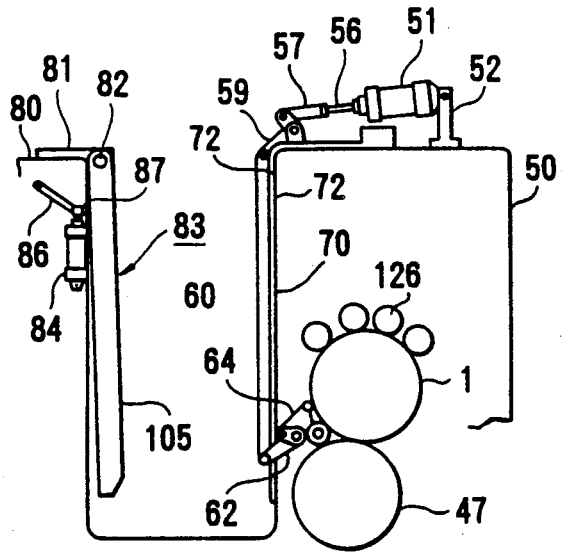
FIGS. 12(*a*) to 12(*h*) are side views showing the overall arrangement and the main part of the plate replacement unit in order to explain plate replacement operations.
Figure 12B:
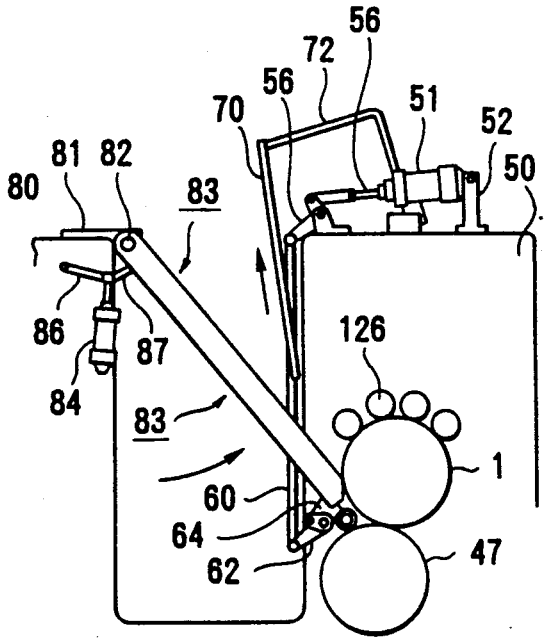
Figure 12C:
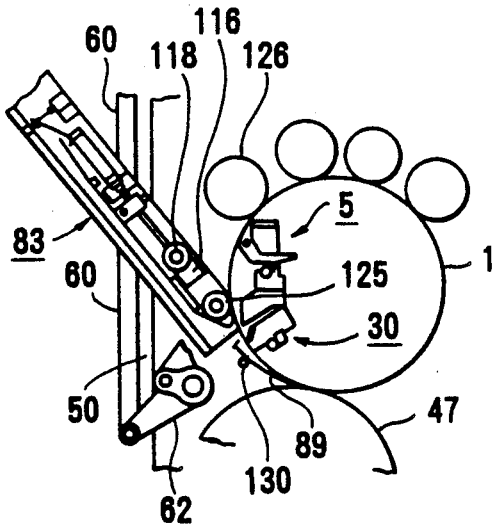
Figure 12D:
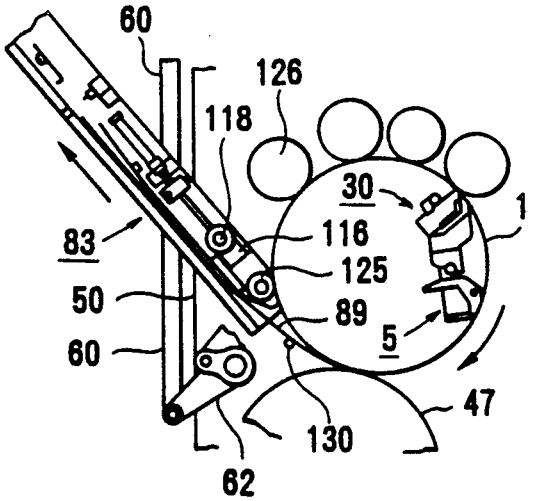
Figure 12E:
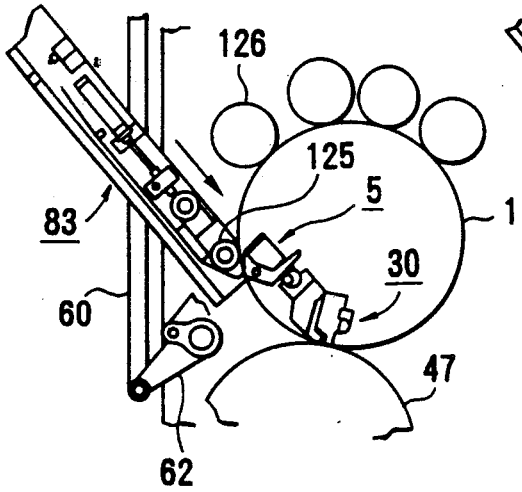
Figure 12F:
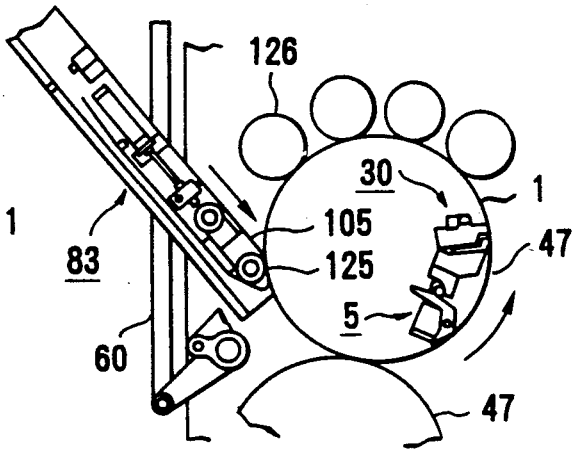
Figure 12G:
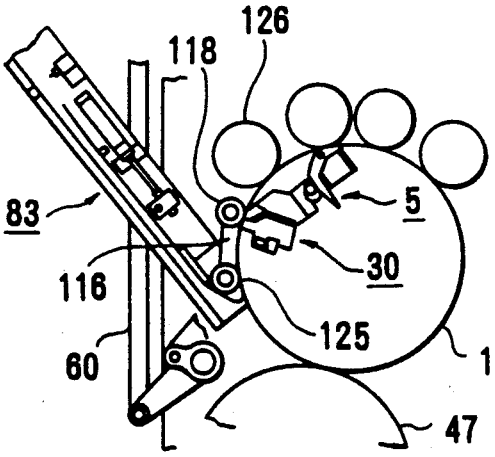
Figure 12H:
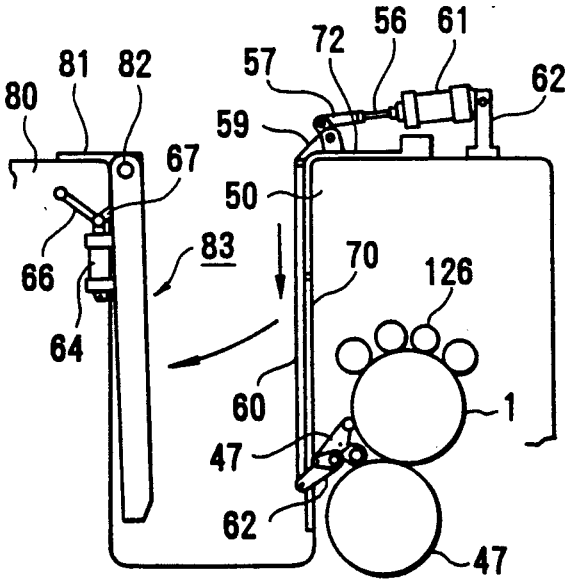

Reference numeral 70 in FIG. 11 denotes a cover for covering the front side of the plate cylinder 1 throughout the entire length thereof. The cover 70 is pivotally supported on a free end portion of an L-shaped lever 72 pivotally supported on the upper end surface of the frame 50 through a bracket 71. An actuation end of a piston rod 74 of an air cylinder 73 pivotally supported on the frame 50 is mounted on the L-shaped lever 72. With this arrangement, when the air cylinder 73 is actuated in response to a command from a control unit, the cover 71 is moved in the range of the position indicated by the solid line and the position indicated by the alternate long and short dashed line.

A plate replacement unit for replacing an old plate with a new plate is arranged in the plate lockup apparatus and the opening/closing unit. That is, a pair of right and left brackets 81 are located obliquely above the plate cylinder 1 and are mounted on the upper ends of the rear sides of right and left frames 80 mounted in a printing unit in front of the frames 50. The proximal end of a loader 83 serving as a plate holding member having a rectangular member whose long side is aligned in the horizontal direction and having almost the same length as the plate cylinder 1 is mounted on a support shaft 82 pivotally mounted on the brackets 81. An air cylinder 84 connected to the control unit is pivotally supported on the right and left frames 80 near the brackets 81. A lever 86 supported by the frame 80 and a lever 87 supported on the loader 83 are connected to an actuation end of a piston rod 85 of the air cylinder 84. With this arrangement, when the piston rod 85 of the air cylinder 84 is reciprocated, the loader 83 is swung through the levers 86 and 87 between a suspended position indicated by the solid line and an inclined position indicated by the alternate long and short dashed line, so that the distal end portion of the loader 83 comes close to or is separated from the circumferential surface of the plate cylinder 1.

Figure 9:
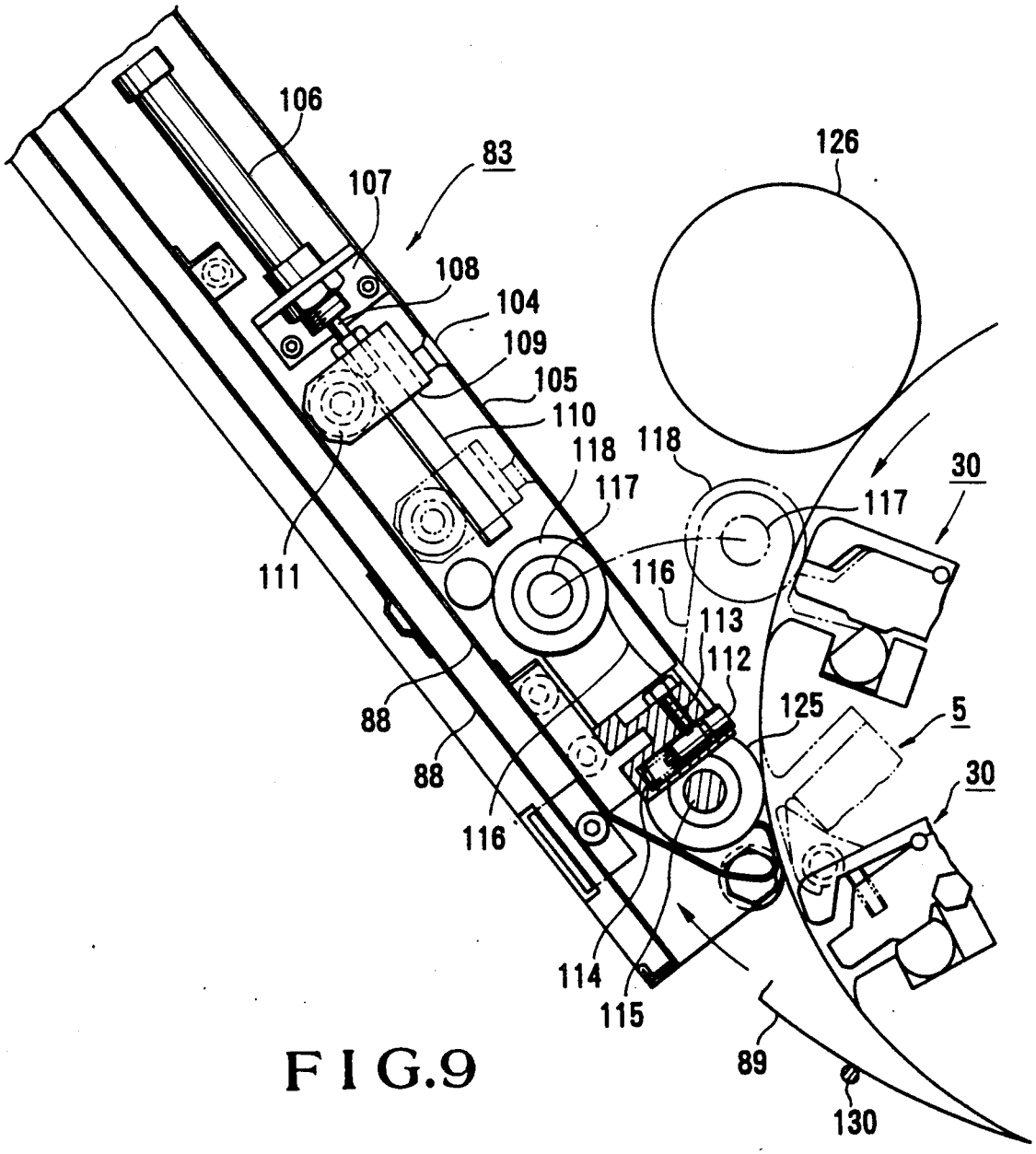
FIG. 9 is a partially cutaway side view showing the lower half of the plate holding unit.
Figure 10:
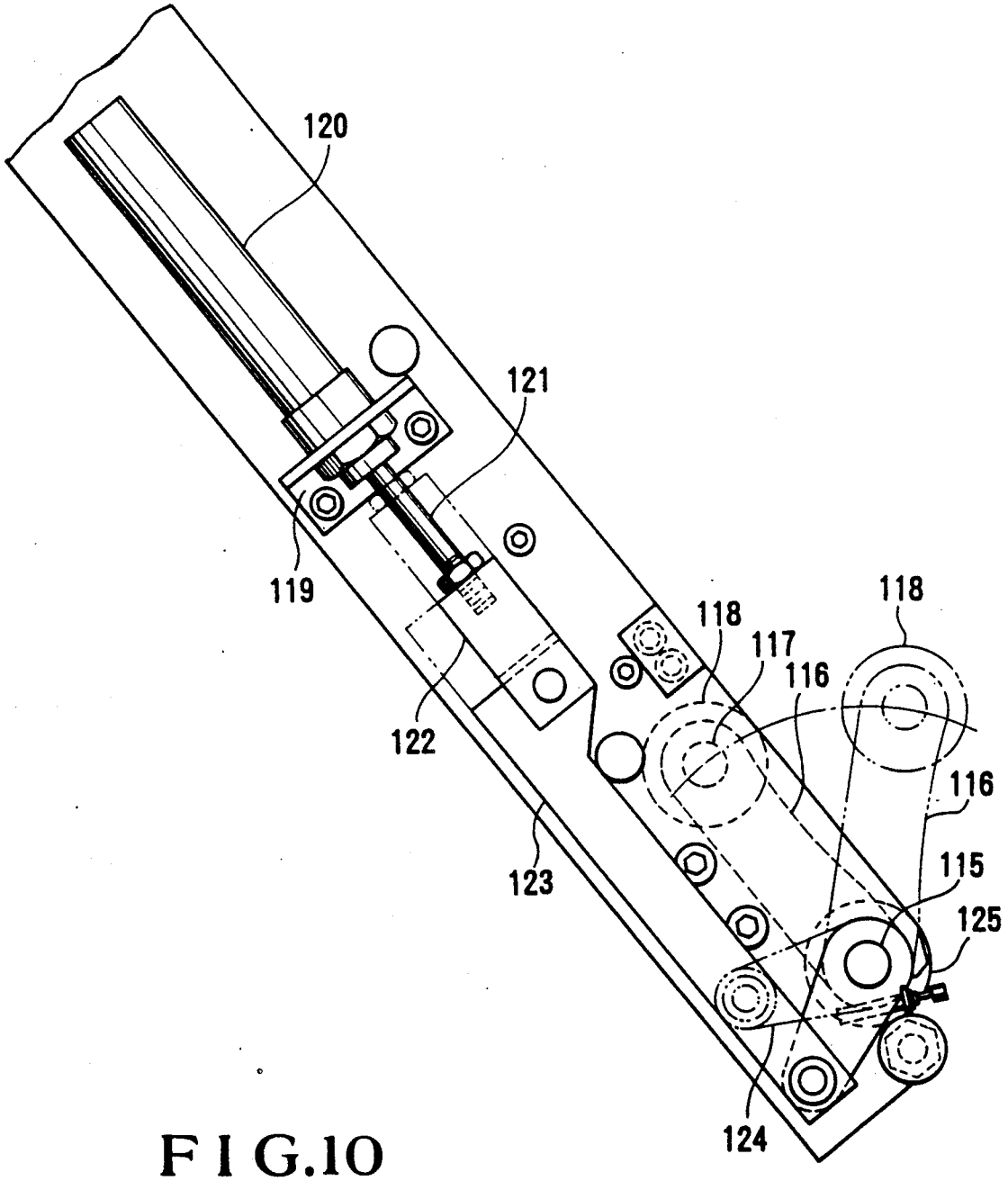
FIG. 10 is a side view of the plate holding unit.

As shown in FIG. 9, two guide plates 88 having a V-shaped inlet vertically extend in the lower half of the loader 83. When the plate lockup devices 5 and 30 are opened, a plate 89 released and rewound upon pivotal movement of the plate cylinder 1 is inserted between the guide plates 88 in a direction indicated by an arrow. A plurality of pairs of brackets 90 (best shown in FIG. 8) each having an oval shape are fixed on the tubular support shaft 82 in the upper end portion of the loader 83 at positions obtained by dividing the overall width of the loader 83 into ⅓. Convex members 91 are supported on the respective pairs of brackets 90. Each convex member 91 has a band-like leaf spring 92 biased in a direction to wind the convex member 91. The fixed end of the leaf spring 92 is fixed to a plate trailing edge holding unit 93. An L-shaped plate hook 95 which is held in an upright position (position of the solid line) by a biasing force of a coil spring 96 is pivotally supported in a holder 94 at the end of the leaf spring 92. A bent portion of the plate 89 entering between the guide plates 88 is hooked by a hook portion of the plate hook 95. That is, prior to the start of replacement of the plate 89, the plate trailing edge holding unit 93 is manually moved downward to the central standby position of the loader 83, and a piston rod 98 of an air cylinder 97 arranged at this standby position is moved forward upon depression of a push button. The plate hook 95 is open to be located at the position of the alternate long and short dashed line against the biasing force of the torsion coil spring 96. When the holder 94 is urged against a cover 99 by the upper end of the plate hook 95, the plate trailing edge holding unit 93 as a whole is prevented from upward movement against the tension of the leaf spring 92. Reference numeral 100 denotes a sensor consisting of a light-emitting element and a light-receiving element located near the air cylinder 97. The sensor 100 detects the leading edge of the plate 89 entering between the guide plates 88, and the piston rod 98 of the air cylinder 97 is moved backward to cause the plate hook 95 to stand against the elastic force of the torsion coil spring 96. The bent portion of the plate 89 is hooked by the plate hook 95, and at the same time, locking by the holder 94 is released, so that the plate trailing edge holding unit 93 as a whole is moved upward together with the plate 89 by the tension of the leaf spring 92. Therefore, the plate 89 is pulled into the loader 83.

A pin 102 is slidably supported in a hole of a block 101 arranged in correspondence with the plate hook 95 at the upper end portion of the loader 83 and is biased in a direction to be removed from the block 101 by a compression coil spring 103. The pin 102 is pushed against the elastic force of the compression coil spring 103 to incline the upper end portion of the plate hook 95 as indicated by the alternate long and short dashed line, thereby releasing the bent portion of the plate 89. Therefore, the plate 89 can be removed from the loader 83.

A plate feed unit will be described below. Upper-, middle- (not shown), and lower-stage suction pads 104 (each stage consists of a plurality of pads) for chucking a new plate 105 to be fed to the plate cylinder 1 in place of the old plate 89 are connected to a suction air source and are arranged on the surface of the loader 83. The lower-stage suction pads 104 are vertically movable. That is, a pair of right and left air cylinders 106 are supported on both side plates of the loader 83 through brackets 107 above the lower-stage suction pads 104. The suction pads 104 are mounted in tandem with each other on a bar 109, both ends of which are fixed to piston rods 108 of the air cylinders 106. When the piston rods 108 are moved forward, the bar 109 which holds the new plate 105 is moved from a position indicated by the solid line to a position indicated by the alternate long and short dashed line, so that the new plate 105 is fed to the leading-side lockup device 5 which is open to the leading edge of the new plate 105. Reference numeral 110 denote racks fixed on the right and left side plates of the loader 83 and meshed with pinions 111 at both ends of the bar 109 to smoothly move the bar 109 backward. Reference numeral 112 denotes a reference pin slidably fitted in a hole of another bar 113 and biased by a compression coil spring 114 to extend to be fitted in a reference hole of the new plate 105, thereby positioning the new plate 105.

Roller arms 116 are fixed at both side portions of an arm shaft 115 extending from the loader 83 at the lower end portion of the loader 83, while the arm shaft 115 is pivotally supported. A plurality of brush-like rollers 118 are pivotally mounted in tandem with each other on a roller shaft 117 supported between the free end portions of the roller arms 116. A lever 123 is fixed through a connecting plate 122 to the actuation end of a piston rod 121 of an air cylinder 120 fixed to one widthwise end of the loader 83 through a bracket 119. The free end portion of a lever 124 fixed on the arm shaft 115 is mounted on the lower end portion of the lever 123. With this arrangement, when the piston rod 121 of the air cylinder 120 is reciprocated, the roller arm 116 can be pivoted in the range between a storage position indicated by the solid line in FIG. 9 and an in-operation position indicated by the alternate long and short dashed line. In the in-operation position, the roller 118 is brought into tight contact with the new plate 105 on the plate cylinder 1, and the inner surface of the new plate 105 is brought into tight contact with the outer circumferential surface of the plate cylinder 1. At the same time, the bent portion of the trailing edge of the new plate 105 is inserted into the open trailing-side lockup device 30. A plurality of brush-like rollers 125 are arranged in tandem with each other on the arm shaft 115 and are brought into slidable contact with the new plate 105 so as to guide it to the plate lockup devices 5. Reference numerals 126 denote form rollers (generally at least four rollers) of an inking apparatus brought into contact with the plate surface on the plate cylinder 1 to apply an ink to the plate surface. The units and apparatuses described above and a servo motor for rotating the plate cylinder 1 are connected through a control unit (not shown) and are operated at predetermined timings.

An operation of the plate lockup apparatus having the above arrangement will be described below. During printing, as shown in FIG. 12(*a*), the loader 83 is suspended from the support shaft 82. In this state, the new plate 105 is chucked by the upper-, middle-, and lower-stage suction pads 104, and the reference pin 112 is fitted in the reference hole, so that the new plate 105 is positioned and mounted in the loader 83. The plate trailing edge holding unit 93 in the loader 83 is manually moved downward. When the air cylinder 97 is operated with the push button, the piston rod 98 is moved forward to urge the plate hook 95. The plate hook 95 is inclined as indicated by the alternate long and short dashed line in FIG. 8 and is thus open.

When printing is completed and the old plate 89 is to be replaced with the new plate 105, a start button is depressed. The air cylinder 73 is actuated to open the cover 70 through the L-shaped lever 72, as indicated by the alternate long and short dashed line in FIG. 11. At the same time, the air cylinder 84 is actuated to incline the loader 83 to a plate replacement position of FIG. 12(*b*) through the levers 86 and 87. The servo motor is rotated to rotate the plate cylinder 1 to a plate removal position. At this time, the right and left air cylinders 51 are simultaneously actuated to cause the right roller 67 to urge the lever 54, so that the plate gripper surface of each trailing-side lockup device 30 is opened. At the same time, the left lever 53A is moved by the left roller to be moved to the position indicated by reference numeral 53B, and the right lever 53 is moved from the position of the solid line to the position of the alternate long and short dashed line, thereby opening the plate gripper surface of each trailing-side lockup device 5. Since the moving directions of the distal ends of the right and left levers 54 and 54A are opposite to each other, the right lever 54 is moved from the position of the alternate long and short dashed line to the position of the solid line in FIG. 13. The left lever 54A coaxial with the right lever 54 is moved from the position indicated by reference numeral 54B to the position indicated by reference numeral 54A. When the left lever 53A is moved from the position indicated by reference numeral 53A to the position indicated by reference numeral 53B, the right lever 53 coaxial with the left lever 53A is moved from the position of the solid line to the position of the alternate long and short dashed line. In this manner, both the leading- and trailing-side lockup devices 5 and 30 are simultaneously opened at the stop position of the plate cylinder 1. At the same time, the levers 53 and 54A return to the position where the plate lockup devices 5 and 30 are closed.

In this state, the trailing edge portion of the old plate 89 is popped up by its rigidity from the trailing-side lockup device and abuts against a guide 130, as shown in FIG. 12(*c*). The plate cylinder 1 is pivoted in a direction opposite to the direction of the arrow in FIG. 9, so that the trailing edge of the old plate 89 is inserted between the guide plates 88 of the loader 83. When the inserted old plate 89 passes through the sensor 100, the sensor 100 detects the plate and drives the air cylinder 97, so that the piston rod 98 is moved backward. The plate hook 95 then stands up, as indicated by the solid line in FIG. 8. As a result, the plate hook 95 hooks the trailing-edge bent end portion of the old plate 89, and locking of the holder 94 is released, the plate trailing-edge holding unit 93 as a whole is moved upward by a tension accumulated by each leaf spring 92 arranged on the corresponding convex member 91. The old plate 89 held on the plate hook 95 is pulled and stored into the loader 83. FIG. 12(*d*) shows a state during removal of the old plate 89.

When plate removal is completed, the servo motor is operated to slightly pivot the plate cylinder 1, and the plate cylinder 1 is stopped so that the open plate gripper surface of the leading-side lockup device 5 reaches a line extended from the new plate 105 held on the loader 83. At the same time, the air cylinder 106 is actuated to rotate the pinions 111 on the racks 110, so that the bar 109 is moved downward. The new plate 105 held by the lower-stage suction pads 104 is guided while being in slidable contact with the rollers 125. The leading edge of the new plate 105 is inserted into the leading-side lockup device 5. At this time, the lever 53 shown in FIG. 7 is located at the position of the alternate long and short dashed line and opposes the roller 67. When the air cylinder 51 is actuated, the cam shaft 19 is rotated together with the lever 53 to close the leading-side lockup device 5, and the new plate 105 is gripped by the leading-side lockup device 5. This state is shown in FIG. 12(*e*).

When the servo motor is operated in this state to pivot the plate cylinder 1 in the direction of the arrow, the new plate 105 is wound around the circumferential surface of the plate cylinder 1, and the trailing edge of the new plate 105 is stopped at a position corresponding to the roller 118. During rotation of the plate cylinder 1, the rollers 125 are rotated while being in rolling contact with the surface of the new plate 105. Therefore, the new plate 105 is brought into tight contact with the circumferential surface of the plate cylinder 1. Thereafter, the air cylinder 120 is actuated to move the piston rod 121 backward. The roller arm 116 is pivoted through the levers 123 and 124, and the brush-like rollers 118 are brought into tight contact with the circumferential surface of the plate cylinder 1, thereby inserting the trailing-edge bent end portion of the new plate 105 into the trailing-side lockup device 30 by the rollers 118. FIG. 12(*f*) shows a state during rotation of the plate cylinder 1. FIG. 12(*g*) shows a state after rotation. When the trailing-edge end portion of the new plate 105 is inserted into the trailing-side plate lockup device 30, the left air cylinder is operated. In this case, the lever 54 has already returned to the position indicated by reference numeral 54A. The roller urges the lever 54A downward, and the pivotal movement of the cam 38 causes closing of the trailing-side plate lockup device 30, thereby gripping the inserted end of the new plate 105. At the end of pivotal movement of the cam 38, the gripper plates 36 become integral with the lockup tables 35, and the gripper plates 36 and the lockup tables 35 are moved together in the circumferential direction of the plate cylinder 1. The new plate 105 is thus kept taut and is brought into tight contact with the circumferential surface of the plate cylinder 1.

The piston rod 85 of the air cylinder 84 is moved backward to pull the levers 86 and 87. The loader 83, is moved downward to the stored state, as shown in FIG. 12(*h*). The cover 70 is covered upon operation of the air cylinder 73. Therefore, printing can be restarted.

After printing is restarted, the pin 102 is pushed at the front side of the loader 83 at a proper timing, and the plate hook 95 is inclined to release the old plate 89. The old plate 89 is removed from the loader 83. As described above, the new plate 105 can be mounted on the loader 83 and can be prepared.

A manual plate attaching/detaching operation by the plate lockup apparatus will be described below. When a wrench is fitted in the hexagonal recess of the cam shaft 19 in the state shown in FIG. 6 and is turned, the large-diameter portion of the cam shaft 19 urges the gripper plates 14, and the gripper plates 14 are pivoted counterclockwise about the shaft 33 against the elastic forces of the compression coil springs 17. The gripper surfaces 14*a* of the gripper plates 14 are open. One end of the plate is inserted between the gripper plates 14 and the lockup tables 6. The cam shaft 19 is pivoted in the direction opposite to the direction described above. The small-diameter portion of the cam shaft 19 is brought into contact with the vertical surfaces of the gripper plates 14, so that the gripper plates 14 are released from the plate gripper cam 20. The gripper plates 14 are pivoted clockwise against the elastic forces of the compression coil springs 17, so that the gripper surfaces 14*a* are closed to grip one end of the plate.

Figure 2:
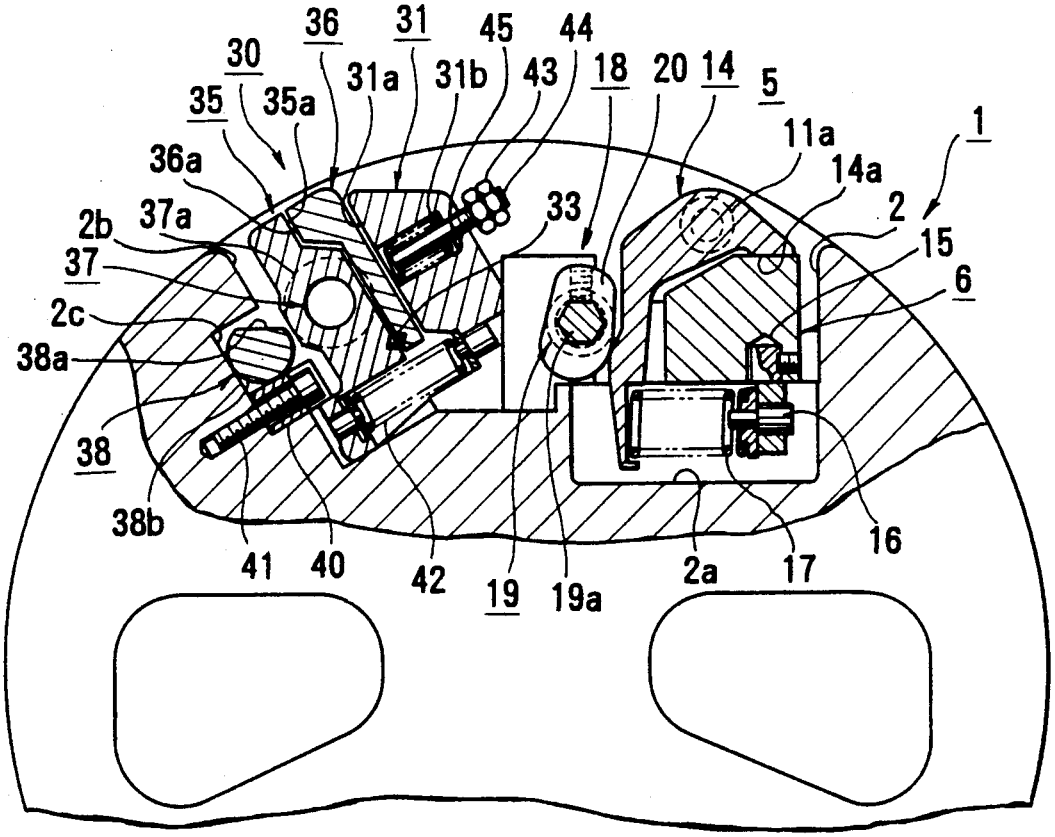
FIG. 2 is a sectional view of the plate cylinder along the line II—II in FIG. 1.
Figure 3:
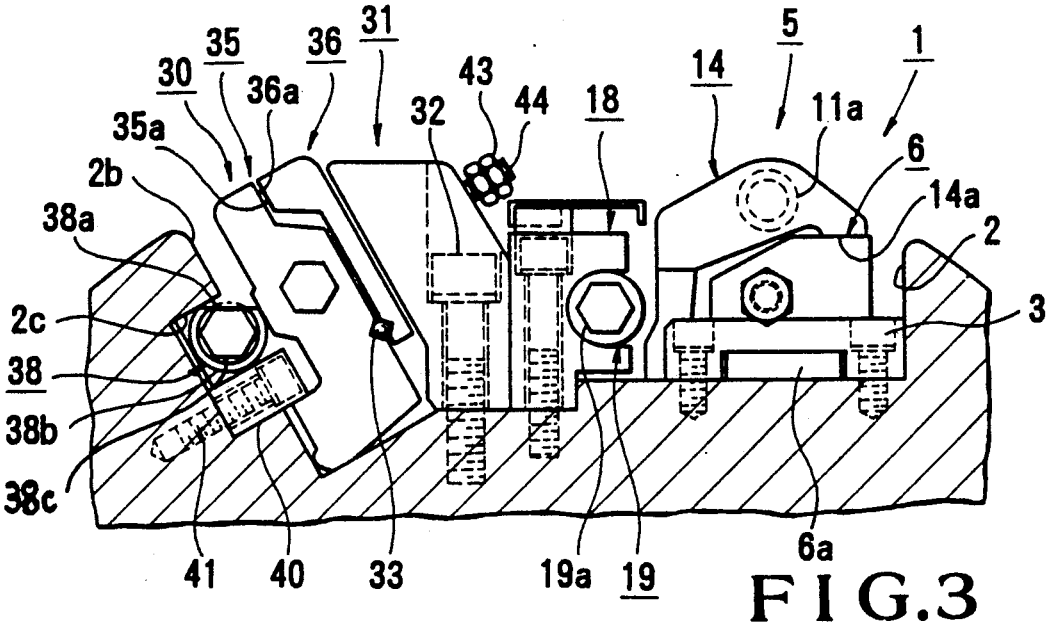
FIG. 3 is a sectional view of the plate cylinder along the line III—III in FIG. 1.
Figure 4:
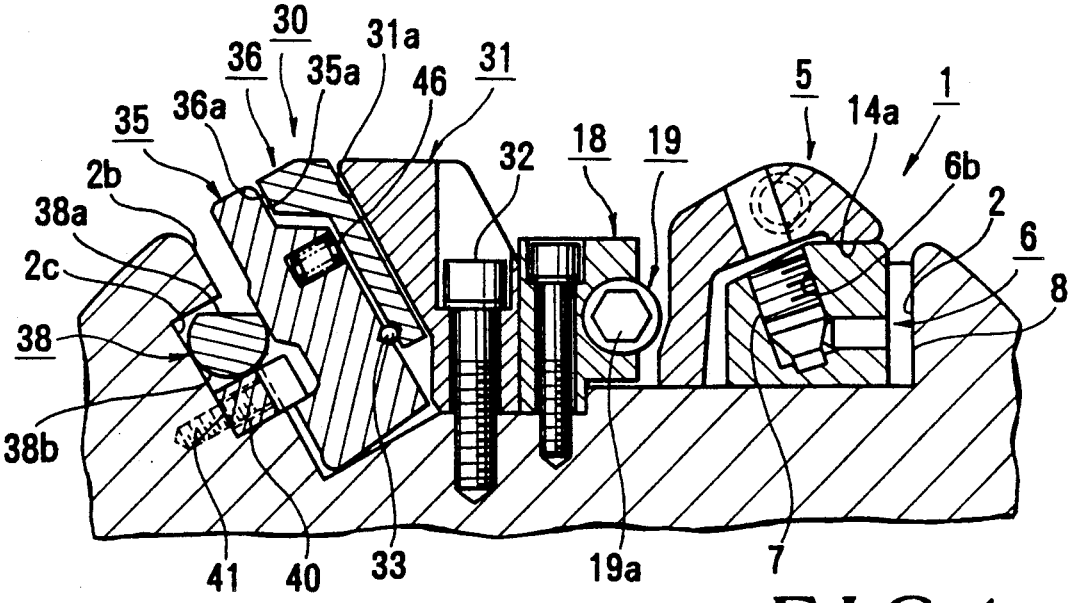
FIG. 4 is a sectional view of the plate cylinder along the line IV—IV in FIG. 1.
Figure 6:
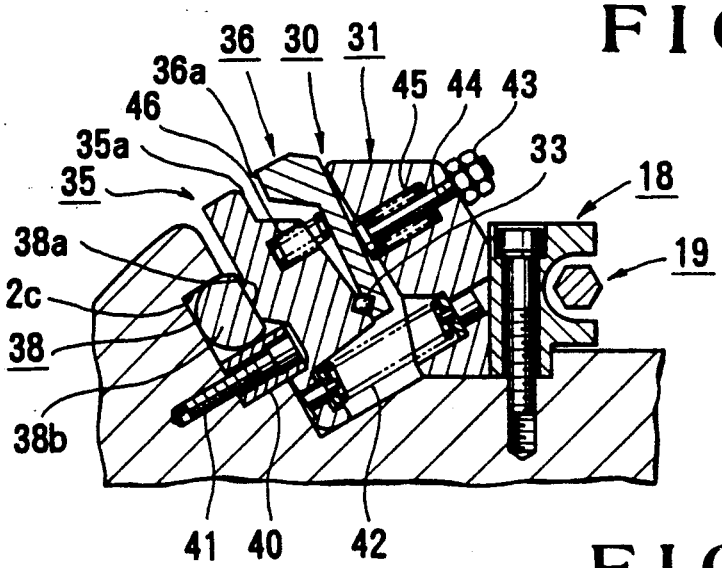
FIG. 6 is a longitudinal sectional view of a trailing-side lockup device before a plate is gripped.

After one end of the plate is gripped, the plate cylinder 1 is rotated by about one revolution. The plate is wound around the circumferential surface of the plate cylinder 1, and the other end (a portion bent at a right angle by a plate bending machine or the like) of the plate is guided to the trailing-side lockup device 30. At this time, as shown in FIG. 6, the small-diameter portion 38 *a* of the cam 38 is in contact with each lockup table 35 to release the corresponding lockup table 35. The lockup tables 35 and the gripper plates 36 are pivoted about the shaft 33 in opposite directions by the elastic forces of the compression coil springs 42, 45, and 46. After the bent portion of the plate is inserted between the gripper surfaces 35*a* of the lockup tables 35 and the gripper surfaces 36*a* of the gripper plates 36, the wrench is fitted into the hexagonal recess of the cam 38 and is pivoted. The cam 38 is pivoted so that the large-diameter portion 38*b* comes close to the corresponding lockup table 35, as shown in FIG. 2. At the beginning of pivotal movement of the cam 38, the lockup table 35 and the corresponding gripper plate 36 stand upright against the biasing forces of the compression coil springs 45 and 46 and grip the bent portion of the plate. When the cam 38 is continuously pivoted and the large-diameter portion 38b urges the corresponding lockup table 35, the lockup table 35 and the gripper plate 36 are moved together in the circumferential direction of the plate cylinder 1 against the biasing forces of the compression coil springs 42, 45, and 46 at the end of pivotal movement of the cam 38. The plate is thus brought into tight contact with the circumferential surface of the plate cylinder 1. At this time, the spring shaft 44 is urged to form a gap between the double nut 43 and the spring reception bar 31. In this manner, upon pivotal movement of the cam 38, plate gripping and plate tightening are continuously performed.

In order to remove the plate from this state, when the cam 38 is pivoted, the lockup tables 35 and the gripper plates 36 are moved together to loosen the plate at the start of pivotal movement, and the double nut 43 is brought into contact with the spring reception bar 31. When the small-diameter portion 38a of the cam 38 is brought into contact with the lockup table 35, the lockup table 35 and the gripper plate 36 shown in FIG. 6 are inclined by the elastic force of the compression coil spring 46, thereby releasing the plate. The plate cylinder 1 is rotated by about one revolution to unwind the plate. When the cam shaft 19 is pivoted to bring the large-diameter portion of each plate gripper cam 20 into contact with the corresponding gripper plate 14, this gripper plate 14 is opened. The other end of the plate is released from all the gripper plates 14, and removal is thus completed. Gripping and release of both ends of the plate, and plate tightening can be performed by the pivotal movement of the cam shaft at one position.

Manual attachment/detachment of the plate by the plate lockup apparatus at the time of plate replacement will be described below. The right air cylinder 51 is actuated at a position where the right roller 67 corresponds to the leading-side lever 53, and the corresponding piston rod 56 is moved backward, the roller 67 urges the lever 53 to the position of the solid line through the link mechanism, and the cam shaft 19 is pivoted to cause the large-diameter portion of the cam 20 to swing each gripper plate 14. The gripper surfaces 14a are opened to release the plate. At this time, the piston rod of the left air cylinder is not moved backward by the interlocked action, and the roller is kept separated from the lever. The pivotal movement of the cam shaft 19 is not prevented. Thereafter, the right air cylinder 51 is actuated to move the piston rod 56 forward, and the roller 67 is kept separated from the lever 53. In this state, when the plate cylinder 1 is pivoted, the left air cylinder is actuated at a position where the left roller corresponds to the trailing-side lever. The piston rod of the left air cylinder is moved backward to pivot the cam 38. The small-diameter portion of the cam 38 is brought into contact with the trailing-side lockup table 35. As shown in FIG. 6, the plate gripper surfaces 35a are opened to release the plate. At this time, the right air cylinder 51 is not moved backward by the interlocking action, and the roller 67 is kept separated from the lever 54, thereby allowing free pivotal movement of the cam 38. The left air cylinder is then actuated to move the piston rod forward, and the roller is kept separated from the lever 54A. The plate is chucked by a suction unit (not shown), and the plate cylinder 1 is rotated by one revolution in the opposite direction. Therefore, the unnecessary plate is removed.

The plate cylinder 1 is pivoted to locate the left roller to a position corresponding to the leading-side lever. When one end of a new plate is inserted into the open leading-side gripper surfaces 14a, the left air cylinder is actuated to move its piston rod backward. The cam shaft 19 is rotated to locate the small-diameter portion of the cam 20 at a position opposite to each gripper plate 14. The gripper plates 14 are closed to grip the plate. Thereafter, the left air cylinder is actuated to move its piston rod forward, and the roller is kept separated from the lever. The plate cylinder 1 pivoted slowly by one revolution in the forward direction, and the bent portion (the other end) of the new plate is inserted into the open trailing-side plate gripper surfaces. The right air cylinder 51 is actuated to move its piston rod 56 backward, and the large-diameter portion of the cam 38 is brought into contact with the lockup tables 35 which are then urged, so that the gripper surfaces 35a are closed to grip the new plate. This gripper operation will be described in more detail. In the gripping operation of the trailing edge of the plate, the small-diameter portion 38a of the cam 38 is in contact with the corresponding lockup table 35 and releases this lockup table 35, as shown in FIG. 6. The lockup tables 35 and the gripper plates 36 are pivoted about the support shaft 33 by the elastic forces of the compression coil springs 42, 45, and 46 in opposite directions. The bent portion of the plate is inserted between the gripper surfaces 35a of the lockup tables 35 and the gripper surfaces 36a of the gripper plates 36, and the air cylinder 51 is actuated. The cam 38 is pivoted so that its large diameter portion 38b comes close to the lockup table 35, as shown in FIG. 2. In the initial pivotal movement of the cam 38, the lockup tables 35 and the gripper plates 36 stand upright against the biasing forces of the compression coil springs 45 and 46 to grip the bent portion of the plate. The cam 38 is continuously pivoted to cause the large-diameter portion 38b to urge the lockup table 35. At the end of pivotal movement of the cam 38, the cam 38 and the lockup table 35 are moved together in the circumferential direction of the plate cylinder 1 against the biasing forces of the compression coil springs 42, 45, and 46. The plate is kept taut and is brought into tight contact with the circumferential surface of the plate cylinder 1. At this time, the spring shaft 44 is urged, and a gap is formed between the double nut 43 and the gripper plate 36. In this manner, upon pivotal movement of the cam 38, plate gripping and plate tightening can be continuously performed. Thereafter, the right air cylinder is actuated to move its piston rod forward, and the roller is kept separated from the lever.

As is apparent from the above description, according to the present invention, in the plate lockup apparatus for a printing press, a trailing-side plate lockup device located in a gap in the circumferential surface of a plate cylinder to grip one end of a plate includes a lockup table and a gripper plate, each having a plate gripper surface radially extending along the plate cylinder so as to grip a bent end of the plate. Gripper-side surfaces of the lockup table and the gripper plate are pivotally connected through a shaft. A cam mechanism is arranged so that a cam has a cam surface brought into contact with the lockup table. At the initial pivotal movement of the cam, the plate gripper surfaces are closed to grip the plate. At the end of pivotal movement of the cam, the lockup table and the gripper plate are moved together in the circumferential direction of the cylinder to tighten the gripped plate. Plate gripping and tightening by the trailing-side lockup device and plate attachment/detachment can be continuously performed upon pivotal movement of the cam shaft. The preparation time can be shortened, productivity can be improved, and labor can be much reduced.

The plate lockup apparatus for a sheet-fed press, according to the present invention, includes leading- and trailing-side lockup devices for gripping one end and the other end of a plate wound around a circumferential surface of a plate cylinder upon pivotal movement of a pair of cam shafts extending in a circumferential gap of the plate cylinder and opening/closing plate gripper surfaces of a lockup device and a gripper plate. Link mechanisms are respectively connected to drive units located near one end and near the other end of the plate cylinder, whereby lever pivot members radial reciprocate along the plate cylinder upon movement of the link mechanisms driven by the drive units which are fixed to cylinder-side end portions of the link mechanisms, a pair of levers are fixed to each of one end and the other end of each cam shaft, and free end portions of each pair of levers are selectively brought into contact with the corresponding lever pivot member. Attachment/detachment of the plate to/from the plate cylinder can be automatically performed. Therefore, labor can be much reduced, the preparation time can be shortened, and productivity can be improved.

An a plate lockup apparatus for a sheet-fed press, according to the present invention, further includes drive units connected to both ends of leading- and trailing-side cam shafts supported in a circumferential gap in the plate cylinder. Upon operation of these drive units, the leading- and trailing-side lockup devices are simultaneously opened in the stop state of the plate cylinder. At the same time, both the cam shafts are closed in different phases of the plate cylinder from the positions where both the lockup devices are open. In this manner, the leading- and trailing-side lockup devices can be simultaneously opened while the plate cylinder is kept stopped. The plate replacement time can be shortened, a total preparation time can be shortened, and productivity can be improved.

What is claimed is:

1. In combination with a printing press of the type having a plate cylinder with a peripheral surface having a gap therein and a plate mounted to said peripheral surface, said plate having a leading edge and a trailing edge received in said gap, the improvement comprising:

leading- and trailing-side lockup devices for gripping said leading and trailing edges of said plate, respectively, when said plate is wound around said peripheral surface of said plate cylinder, said trailing-side lockup device having a cam shaft supported in said gap and each said leading- and trailing-side lockup device having a lockup table and a gripper plate, said cam shaft contacting said lockup table of said trailing-side lockup device so as to urge relative movement between said lockup table and said associated gripper plate of said trailing-side lockup device upon rotation of said cam shaft;

at lest one drive unit mounted adjacent said plate cylinder;

a link mechanism connected to said at least one drive unit;

lever pivot means supported at one end of said link mechanism opposite said at least one drive unit, said lever pivot means being angularly reciprocated upon movement of said link mechanism driven by said at least one drive unit, said lever pivot means having an opposite end; and a lever spaced from said opposite end of said lever pivot means and attached to one end of said cam shaft, said lever being pivoted by said lever pivot means.

2. The combination according to claim 1, wherein said cam shaft comprises a planar small-diameter portion and an arcuated large-diameter portion.

3. The combination according to claim 1, wherein said at least one drive unit comprises air cylinders.

* * * * *

UNITED STATES PATENT AND TRADEMARK OFFICE

CERTIFICATE OF CORRECTION

PATENT NO. : 5,094,165

DATED : March 10, 1992

INVENTOR(S) : Sugiyama et al

It is certified that error appears in the above-identified patent and that said Letters Patent is hereby corrected as shown below:

Column 3, line 23, delete "," and insert ---- ; ----.

Column 14, line 28, delete "large diameter" and insert ---- large-diameter ----.

Column 15, line 27, delete "An a" and insert ---- A ----.

Column 16, line 21, delete "lest" and insert ---- least ----.

Signed and Sealed this

Twenty-fifth Day of May, 1993

*Attest:*

Michael K. Kirk

MICHAEL K. KIRK

*Attesting Officer*

*Acting Commissioner of Patents and Trademarks*